US007037886B2

(12) United States Patent
Smith et al.

(10) Patent No.: US 7,037,886 B2
(45) **Date of Patent: *May 2, 2006**

(54) METHOD FOR MANUFACTURING A MOLDED DETERGENT COMPOSITION

(75) Inventors: Kim R. Smith, Woodbury, MN (US); Victor Fuk-Pong Man, St. Paul, MN (US); Wendy Wiseth, St. Paul, MN (US); Richard Stardig, Minneapolis, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/999,072

(22) Filed: Nov. 30, 2001

(65) Prior Publication Data

US 2002/0173442 A1 Nov. 21, 2002

Related U.S. Application Data

(63) Continuation-in-part of application No. 09/585,009, filed on Jun. 1, 2000, now Pat. No. 6,730,653.

(51) Int. Cl.
*C11D 11/00* (2006.01)

(52) U.S. Cl. ..... 510/451; 510/445

(58) Field of Classification Search ..... 510/451, 510/224, 298, 445, 509, 510, 511, 512
See application file for complete search history.

(56) References Cited

U.S. PATENT DOCUMENTS

| | | | |
|---|---|---|---|
| 3,370,015 | A | 2/1968 | Van Kampen et al. |
| 4,242,217 | A | 12/1980 | Westermann et al. |
| 4,595,520 | A | 6/1986 | Heile et al. |
| 4,680,134 | A | 7/1987 | Heile et al. |
| 4,731,223 | A | 3/1988 | Forestier et al. |
| 4,753,755 | A | 6/1988 | Gansser |
| RE32,763 | E | 10/1988 | Fernholtz et al. |
| RE32,818 | E | 1/1989 | Fernholz et al. |
| 4,931,202 | A | 6/1990 | Cotter et al. |
| 4,933,100 | A | 6/1990 | Ramachandran |
| 4,933,102 | A | 6/1990 | Olson |
| 5,078,301 | A | 1/1992 | Gladfelter et al. |
| 5,080,819 | A | 1/1992 | Morganson et al. |
| 5,474,698 | A | 12/1995 | Rolando et al. |
| 5,482,641 | A | 1/1996 | Fleisher |
| 5,670,467 | A | 9/1997 | Fleisher |
| 5,670,473 | A | 9/1997 | Scepanski |
| 5,674,831 | A | 10/1997 | Schulz et al. |
| 5,698,513 | A | 12/1997 | Schulz et al. |
| 5,713,384 | A | 2/1998 | Roach et al. |
| 6,060,444 | A | 5/2000 | Schulz et al. |
| 6,156,715 | A | 12/2000 | Lentsch et al. |
| 6,172,020 | B1 | 1/2001 | Binstock et al. |
| 6,177,392 | B1 | 1/2001 | Lentsch et al. |
| 6,211,129 | B1 | 4/2001 | Gladfelter et al. |
| 6,258,765 | B1 | 7/2001 | Wei et al. |
| 6,730,653 | B1 * | 5/2004 | Smith et al. ..... 510/451 |

FOREIGN PATENT DOCUMENTS

| | | | |
|---|---|---|---|
| CS | 158897 | | 7/1975 |
| DE | 2526967 | | 1/1976 |
| DE | 3431978 | A1 | 3/1986 |
| DE | 3541153 | A1 | 5/1987 |
| JP | 53120697 | | 10/1978 |
| JP | 56159300 | A2 | 12/1981 |
| JP | 60023159 | | 6/1985 |
| JP | 04055309 | A2 | 2/1992 |
| JP | 09176691 | A2 | 7/1997 |
| JP | 09217100 | A2 * | 8/1997 |
| WO | WO 92/13061 | | 8/1992 |

OTHER PUBLICATIONS

Akiya, T. et al., "Scaling of Sodium Hydroxide 3.5 Hydrate from Sodium Hydroxide-potassium Hydroxide-water System", *Rikogaku Kenkyusho Hokoku, Waseda Daigaku*, vol. 119, pp. 49-55 (1987) (1 page of abstract).

Andon, R. et al., "Thermodynamic Properties of Phosphorus Compounds. II. Low-temperature Heat Capacity and Entropy of Sodium mono-, di-, and Triphosphates", *J. Appl. Chem.*, vol. 17, No. 3, pp. 65-70 (1967) (1 page of abstract).

(Continued)

*Primary Examiner*—Lorna M. Douyon
(74) *Attorney, Agent, or Firm*—Merchant & Gould

(57) ABSTRACT

A method for manufacturing a molded detergent composition is provided. The method includes a step of mixing a hydrated component and a hydratable component to provide a mixture, and molding the mixture to provide a molded detergent composition having a melting point greater than about 30° C. The hydrated component has a melting point below about 100° C. and includes a transhydration product of anhydrous material and water of hydration. The hydrated component is provided in a solid state during the step of mixing. The anhydrous material has a melting point greater than about 300° C. The hydratable component includes water, if present at all, at a level of less than about 2 wt. % based on the weight of the hydratable component. A molded detergent composition and a method for using the molded detergent composition are provided.

15 Claims, No Drawings

OTHER PUBLICATIONS

Burylev, B. et al., "Calculation of the Standard Enthalpies of Formation of Hydrous Sodium Salts", *Inorg. Mater*, vol. 31, No. 6, pp. 727-729 (1995) (1 page of abstract).
Dolkart, A. et al., "Study and Production of Dehydrated Sodium Silicate and Compositions Based on it", *Deposited Doc. SPSTL 273 Khp-D82*, 11 pp. (1982) (1 page of abstract).
Felsche, J. et al., "Thermal Studies on Sodium Silicate Hydrates. II. Disodium Dihydrogensilicate Hydrates, Na2H2SiO4.n H2OIO(n=4, 5, 7, 8); Melting Characteristics and Solidification of Glasslike Hydrate Phases at Low Temperatures", *Thermochim. Acta*, vol. 77, Nos. 1-3, pp. 109-121 (1984) (1 page of abstract).
Galogaza, V. et al. "Some Features of Thermal Behavior of Sodium Triphosphate Hexahydrate, Na5P3010.6H2O", *Thermochim. Acta*, vol. 106, pp. 141-154 (1986) (1 page of abstract).
Gould, R. et al., "Thermal Properties of Sodium Metasilicate Hydrates", *Thermochim. Acta*, vol. 14, No. 3, pp. 299-303 (1976) (1 page of abstract).
Gould, R. et al., "Vapor Pressures and Thermodynamic Properties of Sodium Metasilicate Hydrates", *Chem. Thermodyn*., vol. 8, No. 3, pp. 277-282 (1976) (1 page of abstract).
Guion, J. et al., "Critical Examination and Experimental Determination of Melting Enthalpies and Entropies of Salt Hydrates", *Thermochim. Acta*, vol. 67, Nos. 2-3, pp. 167-179 (1983) (1 page of abstract).
Hayano, I. et al., "Melting Point of NaOH.3.5H2O in Sodium Hydroxide-potassium Hydroxide-water System", *Nippon Kaisui Gakkai-Shi*, vol. 24, No. 132, pp. 253-258 (1971) (1 page of abstract).
Hayano, I. et al., "Melting Point of Sodium Hydroxide-3. 5water and the Behavior of Sodium Chloride and Potassium Chloride in the Sodium Hydroxide-potassium Hydroxide-sodium Chloride-potassium Chloride-water System", *Nippon Kaisui Gakkai-Shi*, vol. 29, No. 6, pp. 261-270 (1976) (1 page of abstract).
Irving, R. et al., "Standard Heats of Formation of the Sodium Triphosphates Na5P3010(cI), and Na5P3O1O.6H2O(c)", *Trans. Faraday Soc*., vol. 64, No. 4, pp. 875-878 (1968) (1 page of abstract).
Jotshi, C. et al., "Thermal Energy Storage in Phase Change Materials for Heating Applications", *Proc. Intersoc. Energy Convers. Eng. Conf*., vol. 2, 30th, pp. 207-212 (1995) (1 page of abstract).
Leipoldt, D., "Cold and Heat Storage by Phase Transformations of Material Mixtures", *DKV-Tagungsber*., vol. 13, pp. 253-266 (1986) (1 page of abstract).
Mollakov, B. et al., "Heat-accumulating Possibilities of Sodium Hydroxide Monohydrate in Water Solutions", *Izv. Akad. Nauk Turkm. SSR, Ser. Fiz.-Tekh, Khim. Geol. Nauk*, No. 5, pp. 89-91 (1987) (1 page of abstract).
Mraw, S. et al., "Entropies of the Hydrates of Sodium Hydroxide. III. Low-temperature Heat Capabilities and Heats of Fusion of the .Alpha. and .Beta. Crystalline Forms of Sodium Hydroxide Tetrahydrate", *J. Phys. Chem*., vol. 78, No. 17, pp. 1704 1709 (1974) (1 page of abstract).
Porisini, F., "Salt Hydrates used for Latent Heat Storage: Corrosion of Metals and Reliability of Thermal Performance", *Sol. Energy*, vol. 41, No. 2, pp. 193-197 (1988) (1 page of abstract).
Siemens, P. et al., "Entropies of the Hydrates of Sodium Hydroxide. II. Low-temperature Heat Capabilities and Heats of Fusion of NaOH.2H2O and NaOH.3.5H2O", *J. Phys. Chem.*, vol. 73, No. 1, pp. 149-157 (1969) (1 page of abstract).
Siemens, P., "Hydrates of Sodium Hydroxide: Their Thermodynamic Properties at 298.15.deg.K. Entropies of NaOH.2H2O and NaOH.3.5H2O from their Low-temperature Heat Capacities", *Diss. Abstr. B*, vol. 29, No. 12 (1969) (1 page of abstract).
Sharma, S. et al., "An Empirical Correlation for Viscosity of Molten Salt Hydrates", *Can. J. Chem. Eng*., vol. 62, pp. 431-433 (1984) (1 page of abstract).
Sharma, S. et al., "Viscosity of Molten Sodium Salt Hydrates",*J. Chem. Eng. Data*, vol. 29, No. 3, pp. 245-246 (1984) (1 page of abstract).
Sharma, S. et al., "Density of Molten Salt Hydrates—Experimental Data and an Empirical Correlation", *Can. J. Chem. Eng*., vol. 65, No. 1, pp. 171-174 (1987) (1 page of abstract).
Tereshkova, S., "Mechanism of Reciprocal-sequential Dehydration of Phosphate Hydrate Crystals", *Zh. Fiz. Khim*., vol. 68, No. 4, pp. 742-746 (1994) (1 page of abstract).
Tereshkova, S., et al. "Thermochemistry of the Multistep Transformations of Pentasodium Triphosphate and Trisodium Tricyclophosphate Crystal Hydrates",*Zh. Fiz. Khim*., vol. 66, No. 10, pp. 2604-2611 (1992) (1 page of abstract).
Watanabe, M. et al., "Thermal Behavior of Hydrated Triphosphates", *Phosphorus Res. Bull*., vol. 4, pp. 117-122 (1994) (1 page of abstract).

* cited by examiner

METHOD FOR MANUFACTURING A MOLDED DETERGENT COMPOSITION

CROSS REFERENCE TO RELATED APPLICATION

This is a continuation-in-part of U.S. patent application Ser. No. 09/585,009 that was filed on Jun. 1, 2000, now U.S. Pat. No. 6,730,653 U.S. patent application Ser. No. 09/585,009 is incorporated herein by reference in its entirety.

FIELD OF THE INVENTION

The invention relates to molded detergent compositions and methods for manufacturing and using molded detergent compositions.

BACKGROUND OF THE INVENTION

Solid detergent compositions are described in the prior art. See U.S. Pat. Nos. RE 32,763 to Fernholtz, et al., U.S. Pat. No. RE 32,818 to Fernholtz, et al., U.S. Pat. No. 4,595,520 to Heile et al.; U.S. Pat. No. 4,680,134 to Heile et al.; U.S. Pat. No. 5,078,301 to Gladfelter et al.; and U.S. Pat. No. 5,080,819 to Morganson et al. The solid detergent compositions prepared according to these United States patents incorporate carbonate, caustic, silicate and other materials in combination with a variety of nonionic surfactants made using EO, PO, or EO and PO groups. In addition, U.S. Pat. Nos. 4,753,755 to Gansser; U.S. Pat. No. 4,931,202 to Cotter et al.; U.S. Pat. No. 5,482,641 to Fleisher; and U.S. Pat. No. 5,670,467 to Fleisher disclose the use of nonionic surfactants in solid detergents. Many of the processes described in the prior art require the application of heat in the formation of solid detergent blocks.

Solid detergent blocks are desirable because they generally require less shelf space than liquid detergents, they are generally easier to handle than liquid detergents, and they reduce the splashing hazard common to the use of liquid detergents.

SUMMARY OF THE INVENTION

A method for manufacturing a molded detergent composition is provided by the invention. The method includes steps of mixing a hydrated component and a hydratable component to provide a mixture, and molding the mixture to provide a molded detergent composition having a melting point greater than about 30° C. The hydrated component has a melting point below about 100° C. and includes a transhydration product of an anhydrous material and water of hydration. The anhydrous material has a melting point greater than about 300° C. The hydrated component is provided in a solid state during the step of mixing. A solid state of the hydrated component can be characterized by the presence of a crystalline structure and water of hydration that participates in the crystalline structure. The hydratable component can be provided free of water. If the hydratable component includes water, it is provided at a level of less than about 2 wt. % based on the weight of the hydratable component. The hydratable component will successfully compete with the hydrated component for at least a portion of the water of hydration of the hydrated component.

The hydrated component can include any hydrated material having a melting point below about 100° C. which, when water of hydration is removed therefrom, has a melting point greater than about 300° C., and which surrenders water of hydration to the hydratable component. The hydrated component can be a material that remains solid and surrenders water of hydration to the hydratable component under the conditions of mixing and molding to provide the molded detergent composition having a melting point greater than about 30° C. The hydrated component can include a hydrated salt. Exemplary hydrated salts include sodium silicate, lithium silicate, potassium silicate, sodium metasilicate, sodium phosphate, calcium phosphate, magnesium phosphate, sodium pyrophosphate, sodium tripolyphosphate, sodium sulfate, sodium carbonate, sodium bicarbonate, sodium sesquicarbonate, sodium bisulfate, sodium thiosulfate, sodium perborate, and mixtures thereof.

The hydratable component can include any material having a water content of less than about 2 wt. % and that successfully competes with the hydrated component for at least a portion of the water of hydration under the conditions of mixing and/or molding to provide the molded detergent composition with a melting point greater than about 30° C. The conditions of mixing and/or molding can be provided at a temperature of less than 50° C., or less than 40° C., or less than 30° C., or at room temperature. It should be understood that the temperature should be sufficiently high to allow the reaction to proceed. The hydratable component can be either a solid or a liquid under conditions of mixing and/or molding to provide the molded detergent composition. When both the hydrated component and the hydratable component are solid during conditions of mixing and/or molding, it is believed that the reaction between the hydrated component and the hydratable component can be referred to as a solid state reaction. The hydratable component can be a polar organic material. Exemplary hydratable components include at least one of nonionic surfactants, anionic surfactants, glycol ethers, and mixture thereof.

The mixture can include additional components. Exemplary additional components include enzymes, solvents having high VOC content, dyes, fragrances, anti-redeposition agents, corrosion inhibitors, buffering agents, defoamers, anti-microbial agents, and preservatives. Additional components that can be provided in the molded detergent composition can be characterized as heat sensitive materials if elevated temperatures cause degradation or removal of the components. It is an advantage of the invention that the process can be carried out at temperatures below about 50° C. or 40° C. or 30° C., and materials that would be considered heat sensitive at temperatures outside of these ranges can be processed by the method according to the invention.

The weight ratio of the hydrated component to the hydratable component is selected to provide a molded detergent composition having a melting point greater than about 30° C. The weight ratio of the hydrated component to the hydratable component can be between about 2:1 and about 20:1, and can be between about 3:1 and about 10:1. It should be understood that in determining this weight ratio, the weight of the hydrated component includes its water of hydration, and the weight of the hydratable component includes its water of hydration if it has any water of hydration. The weight ratio of the hydrated component to the hydratable component can be expressed on an anhydrous weight basis for each component. On an anhydrous weight basis for each component, the weight ratio of hydrated component to hydratable component can be between about 5:1 and about 20:1, and can be between about 1:8 and about 5:1.

A molded detergent composition is provided according to the invention. The molded detergent composition includes a result of mixing and molding a composition including a hydrated component and a hydratable component. The steps of mixing and molding are believed to include a reaction that can be characterized as a competition reaction for water of hydration. That is, it is believed that the hydrated component and the hydratable component compete for water of hydration and the competition results in at least a portion of the water of hydration from the hydrated component becoming water of hydration for the hydratable component. In addition, it is believed that this competitive hydration reaction causes the hydrated component and the hydratable component to form a solid composition when mixed and molded having a melting point greater than about 30° C. Although the composition that is mixed and molded can include free water, it is expected that the presence of free water may interfere or slow down the competitive hydration reaction.

A method for washing an article is provided according to the invention. The method includes steps of generating an aqueous use solution from a molded detergent composition, and washing an article with the aqueous use solution. The aqueous use solution can be obtained by running water over the molded detergent composition, and allowing the formed aqeuous use solution to drain from the molded detergent composition. The active level of the aqueous use solution can be adjusted to a desired level by controlling the length of time and the temperature at which the water contacts the molded detergent composition. Exemplary articles that can be washed according to the invention include laundry, carpets, ware, and hard surfaces.

DETAILED DESCRIPTION OF THE PREFERRED EMBODIMENT

A molded detergent composition according to the invention can be used in available solid detergent dispensing equipment. It should be understood that the phrase "molded detergent composition" describes compositions that have been molded to provide a particular shape and which are solid under conditions of room temperature and atmospheric pressure. The molded detergent according to the invention is preferably provided in the form of blocks and/or pellets. Powder detergents in a flowable powdery state and liquid detergents under conditions of room temperature and atmosphere pressure are not considered molded detergent compositions according to the invention. In contrast to blocks and pellets, powder detergents are generally available for use as detergents in a powdered state. That is, the powder detergents are generally provided as a mixture of granular dry material. Powder detergents are often prepared by mixing dry materials or by mixing a slurry and drying the slurry. Pellets and blocks are typically provided with a size that is determined by the shape or configuration of the mold or extruder through which the detergent composition is compressed. Pellets generally can be characterized as having an average diameter of about 0.5 cm to about 2 cm. Blocks generally can be characterized as having an average diameter of greater than about 2 cm. In general, blocks have an average diameter of between about 2 cm and about 2 ft, and can have an average diameter of between about 2 cm and about 1 ft.

The molded detergent composition according to the invention can be used in conventional solid detergent dispensing equipment. Commercially available solid detergent dispensing equipment which can be used to process the molded detergent composition according to the invention are available under the name Solid System® from Ecolab Inc. In general, a detergent use solution is generated in this type of equipment as a result of erosion of the molded detergent composition by a water stream.

The molded detergent composition can be prepared by mixing the hydrated component and the hydratable component, and molding the mixture to provide a molded detergent composition having a melting point greater than about 30° C. The hydrated component can be a component having a melting point below about 100° C. and can be characterized as a transhydration product of an anhydrous material and water of hydration. The anhydrous material of the hydrated component can have a melting point greater than about 300° C. It should be understood that there is no requirement that the hydrated component is to be prepared from an anhydrous material. That is, the hydrated component that is used according to the invention can be obtained as a material having water of hydration or it can be manufactured from an anhydrous material by adding water of hydration. Furthermore, it should be understood that the "anhydrous material" refers to the hydrated component under a condition where water has been removed to an extent reasonable under normal processing conditions for the removal of water. If it is too difficult to remove all of the water, then the "anhydrous material" refers to the hydrated component with as much water removed as reasonable after normal processing conditions for the removal of water. When the anhydrous material is hydrated with water, the melting point decreases from greater than about 300° C. for the anhydrous material to below about 100° C. for the hydrated component. The hydratable component can be provided free of water, although it is likely to include a small amount of water as a result of atmospheric conditions. If water is present in the hydratable component, it can be provided at a level of less than about 2 wt. % based on the weight of the hydratable component. The amount of water provided in the hydratable component can be less than about 1 wt. %, and can be less than about 0.5 wt. %. The hydratable component can additionally be characterized as a component which successfully competes with the hydrated component for at least a portion of the water of hydration provided as part of the hydrated component. It is believed that the movement of the water of hydration from the hydrated component to the hydratable component provides for controlling the solidification of the mixture. It is believed that the rate of solidification of the mixture can be adjusted by controlling the competitive hydration reaction.

It is believed that the interaction between the hydrated component and the hydratable component results in a competitive hydration reaction where at least a portion of the water of hydration moves from the hydrated component to the hydratable component. Under the conditions of reaction, the hydrated component can remain in a solid state. By being provided in a solid state, the hydrated component will have a crystal structure with water of hydration participating in the crystalline lattice. The conditions of reaction between the hydrated component and the hydratable component can be controlled so that the hydrated component does not melt. A melt of the hydrated component can be characterized as a flowable liquid composition having an absence of crystal structure and without water of hydration participating in the crystalline lattice structure as determined by X-ray crystallography. During the competitive hydration reaction, the hydrated component can be provided in a solid state, and the hydratable component can be provided in either the solid state or the liquid state. When both the hydrated component and the hydratable component are provided in a solid state, the competitive hydration reaction can be characterized as a solid state reaction. It is understood that heating a hydrated material to a temperature that results in melting of the hydrated material to a liquid state results in the destruction of the crystal structure of the material and the removal of water of hydration. Under melted conditions, the water of hydration would become free water. Melting the hydrated component according to the invention would cause the hydrated component to lose its water of hydration, and the hydrated component would no longer be considered a "hydrated component" when it is provided as a melt.

The mixed composition can be shaped by conventional molding techniques including casting, compressing in a mold, and extruding. It is an advantage of the invention that the steps of mixing and molding can be practiced without a step of adding heat to the mixture. It should be understood that heat can be added to the mixture by conventional heat transfer techniques and/or by adding energy to the mixture by, for example, mixing. It should be understood that the phrase "without a step of adding heat to the mixture" refers to the absence of deliberately heating the mixture by standard heat transfer techniques to increase the temperature of the mixture. The statement that the steps of mixing and molding can be practiced without a step of adding heat to the mixture is not meant to imply that energy is not applied to the mixture. In fact, it is expected that the step of mixing and molding will result in energy being applied to the mixture in the form of mechanical energy by mixing and by molding. In addition, it is expected that adding mechanical energy might result in an increase in temperature. Although the steps of mixing and molding can be practiced without a step of adding heat to the mixture, it should be understood that heat can be added to the mixture if it is desired to increase the temperature of the mixture to facilitate the competitive hydration reaction or to assist with the steps of mixing and molding. Although the temperature of the mixture can be increased by adding heat, it is expected that the temperature of the mixture will not be increased to an extent that results in melting of the hydrated component. The hydrated component can remain in a solid state that includes water of hydration during the competitive hydration reaction. It is believed that during the mixing and molding steps, the hydrated component and the hydratable component compete for the water of hydration. The hydratable component sufficiently hydrates to provide a solid detergent composition having a melting point of greater than about 30° C., and the melting point can be greater than about 50° C. The melting point of the molded detergent composition can be sufficiently high so that the composition does not melt under conditions commonly encountered in a warehouse. Typical warehouses often experience temperatures ranging between about 30° C. and about 50° C.

The steps of mixing and molding the mixture can be practiced so that the mixture does not exceed a temperature of about 50° C. The temperature of the mixture during the steps of mixing and molding can be provided at less than about 40° C., and can be provided at less than about 30° C. Depending upon additional materials or components provided in the mixture, it may be desirable to select a temperature that does not result in denaturing, deterioration, or devolatilization of the additional material or component.

The hydrated component is preferably a material which has been at least partially hydrated. The hydrated material should contain a sufficient amount of the water of hydration so that at least a portion of the water of hydration will move to the hydratable component. There is no requirement that the hydrated component must be fully hydrated. The hydrated component can be purchased in a hydrated state or it can be hydrated to obtain a target hydration level. The target hydration level of the hydrated component is selected to provide the final composition with a melting point greater than about 30° C.

The hydratable component refers to a material which competes with the hydrated component for water of hydration. The hydratable component can be referred to as substantially anhydrous. By substantially anhydrous, it is meant that the component contains less than about 2 wt. % by weight water based upon the weight of the hydratable component. The amount of water can be less than about 1 wt. %, and can be less than about 0.5 wt. %. It should be understood that the reference to water includes water of hydration and free water. The phrase "water of hydration" refers to water which is somehow attractively bound to a non-water molecule. An exemplary form of attraction includes hydrogen bonding. There is no requirement that the hydratable component be completely anhydrous. The hydratable component can include water of hydration, but it should be appreciated that the hydratable component is provided for pulling water of hydration away from the hydrated component. Accordingly, although the hydratable component need not be completely anhydrous, it should be sufficiently anhydrous so that it will successfully compete with the hydrated component for water of hydration.

It is believed that the level of hydration of the hydrated and hydratable components of the composition change during the solidification of the molded detergent compositions. That is, the hydrated component loses at least a portion of the water of hydration, and the hydratable component gains water of hydration. It is expected that the level of hydration of the materials in the molded detergent composition will be different from the level of hydration of the starting materials.

The hydrated component can include inorganic materials. The hydrated component can include at least one hydrated salt or a mixture of hydrated salts which, when combined with the hydratable component, surrenders the water of hydration to the hydratable component. The hydratable component can include a material or a mixture of materials having an ability to hydrogen bond with water, and can successfully compete with the hydrated component for the water of hydration provided with the hydrated component. The hydratable component can include organic materials. The competition between the hydrated component and the hydratable component for water of hydration can be expressed by the following formula where, in this instance, the hydrated component is characterized as an inorganic component, and the hydratable component is characterized as an organic material.

$$\text{Inorganic}\cdot n\ H_2O + \text{Organic} \rightarrow \text{Inorganic}\cdot(n-x)H_2O + \text{Organic}\cdot x\ H_2O$$

wherein n is the moles of hydration provided with the hydrated material, and x is the moles of hydration which can be removed from the hydrated component. The value of n can be between about 1 and about 12, can be between about 1 and about 6, and can be between about 2 and about 5. The value of x can be between about 1 and about 12. It should be understood that x is equal to or less than n, and the resulting composition has a melting point of greater than about 30° C.

Exemplary salts which can be hydrated and used as the hydrated component according to the invention include sodium silicate, lithium silicate, potassium silicate, sodium metasilicate, sodium phosphate, calcium phosphate, magnesium phosphate, sodium pyrophosphate, sodium tripolyphosphate, sodium sulfate, sodium carbonate, sodium bicarbonate, sodium sesquicarbonate, sodium bisulfate, sodium thiosulfate, sodium perborate, and mixtures thereof.

The hydrated component can be purchased in the hydrated state, or can be hydrated by a pre-hydration step. In general, a material which is to be hydrated can be mixed with water under conditions which allow the water to become water of hydration. The hydrated component can be provided with or without free water. It should be understood that free water refers to water present that is not water of hydration. Free water is believed to compete with the water of hydration. That is, the hydratable component will likely hydrate using the free water prior to hydrating using the water of hydration. As a result, the presence of free water will likely decrease the rate of forming the molding detergent composition. If it is desirable to accelerate the rate of reaction, it is likely desirable to reduce the presence of free water or exclude the presence of free water. If it is desirable to decrease the rate of solidification, it may be desirable to have free water present. For example, if a composition including a hydrated component and a hydratable component solidifies too quickly, it may be advantageous to add an amount of free water to delay the competitive reaction for water of hydration.

The hydrated component can be provided from an anhydrous inorganic material having a melting point which is generally greater than about 300° C. or greater than about 500° C. As the anhydrous inorganic material become hydrated, the melting point decreases. For a mono-hydrate of an inorganic material, the melting point can be below about 100° C.

The salts which can be hydrated and used as the hydrated component according to the invention generally exhibit a significantly higher melting point when anhydrous than when hydrated. For example, anhydrous sodium acetate has a melting point of about 324° C. Sodium acetate hydrated with three moles of water has a melting point of about 58° C. Anhydrous sodium carbonate has a melting point of about 850° C., but sodium carbonate hydrated with one mole of water has a melting point of about 100° C. and sodium carbonate hydrated with ten moles of water has a melting point of about 34° C. Anhydrous sodium phosphate has a melting point of about 1,340° C., but sodium phosphate hydrated with 12 moles of water has a melting point of about 73° C. Anhydrous sodium silicate has a melting point of about 1,089° C., and sodium silicate hydrated with about five moles of water has a melting point of about 72° C.

The hydratable component is a material which successfully competes with the hydrated component for water of hydration. The hydratable component can be a polar organic component such as a nonionic surfactant, an anionic surfactant, or a mixture of nonionic surfactant and anionic surfactant. Exemplary nonionic surfactants include ethoxylates, ethoxylate/propoxylate copolymers, and alkyl polyglycosides. Exemplary ethoxylates include alcohol ethoxylates containing 1–20 ethylene oxide groups. Exemplary ethoxylates/propoxylate copolymers include those having a number average molecular weight of about 500 to about 100,000. Exemplary nonionic surfactants include myristeth (7 EO), nonylphenol ethoxylate (9 EO), ethylene oxide polymers, propylene polymers, ethylene oxide/propylene oxide copolymers, decylpolyglycoside (DP 1.7), laureth-(9EO) benzyl capped, and mixtures thereof. An exemplary anionic surfactant includes a sodium salt of dodecylbenzene sulfonic acid, sodium alpha-dodecenyl sulfonate, potassium salt of the sulfonated methyl ester of cocofatty acid, sodium tallow sulfonate, disodium decyldi(benzene sulfonate), ammonium lauryl ether sulfate, and magnesium tetradecyl sulfate. The hydratable component can include a solvent such as a glycol ether solvent. Exemplary glycol ether solvents include alkyl glycol ether solvents having an alkyl group containing one to ten carbon atoms and containing one to three glycol ether repeating units.

The hydrated component and the hydratable component are preferably mixed at a weight ratio which results in the formation of a solid composition having a melting point which is greater than about 30° C. It is generally desirable to provide a sufficient amount of the hydrated component so that, when it loses its water of hydration, there is enough of the material to provide the solid composition with a melting point greater than about 30° C. As discussed previously, as the hydrated component loses its water of hydration, the melting point of the material increases. When the hydrated component loses all of its water of hydration, it is an anhydrous material having a melting point of greater than about 300° C., and may be greater than about 500° C. In order to provide the resulting molded composition with a melting point greater than about 30° C., the hydrated component can be provided in an amount that corresponds to an amount of its anhydrous material in the molded composition of at least about 40 wt. % based upon the weight of the molded material. In addition, the amount of the hydrated component can be provided that corresponds to an amount of the anhydrous component in the molded composition that is less than about 90 wt. % based on the weight of the molded composition. The amount of hydrated component can be provided so that the molded composition contains between about 50 wt. % and about 80 wt. % of its anhydrous material based on the weight of the molded composition.

The amount of the hydrated component can be expressed in terms of the amount of its anhydrous material. This is because the amount of water of hydration can vary significantly thereby effecting the actual weight percent value of the hydrated component. Furthermore, it is believed that it is the interaction between the hydrated material and the hydratable material which results in the solidification of the molded composition. It is believed that the structure of the molded composition can be theoretically modeled by comparison to a matrix structure being held in place by glue. In this model, the hydrated material forms the matrix, and the hydratable component acts as the glue. If there is too little glue, the matrix component is not held together. If there is too much glue, the resulting composition is too mushy to be considered a solid composition. The weight ratio of hydrated component to hydratable component, on a dry basis (free of water of hydration), can be between about 5:1 and about 20:1, and more preferably between about 8:1 and about 15:1.

The melting point of the molded detergent composition can vary depending upon the technique used to mold the composition. When casting to provide a molded detergent composition, the melting point can be between about 30° C. and about 50° C. When extruding to provide a molded detergent composition, the melting point can be between about 50° C. and about 100° C. Of course, the melting point of the molded detergent composition can be higher than 50° C. when it is prepared by casting, and it can be greater than 100° C. when it is prepared by extrusion. In general, when molding by casting, it is generally desirable to handle a composition which is relatively soft. In contrast, when molding by extruding under higher pressure and temperature, it is desirable for the composition to be less soft.

The selection of the hydrated component and the hydratable component and the ratio of the components is, at least in part, determined by the length of time it takes to solidify the composition. If the composition solidifies too quickly, there may not be enough time to provide the composition in a desired molded shape. In addition, if the solidification proceeds too slowly, it may become too costly to wait for the solidification to occur. In the case of molding by extrusion, it is generally desirable for the solidification to take between about 1 minute and about 15 minutes, and more preferably between about 5 minutes and about 10 minutes. When casting, it is generally desirable to provide the solidification at a time of between about 15 minutes and about 30 minutes.

A solid detergent composition according to the invention can include additional components. The composition preferably includes a sufficient amount of the hydrated component and hydratable component to provide a detergent composition having a melting point of greater than about 30° C. The detergent composition can include at least about 50 wt. % of the combined hydrated component and the hydratable component. The detergent composition can include at least about 75 wt. % of the combined hydrated component and the hydratable component.

Additional components which can be incorporated into the solid detergent composition include enzymes, solvents having high VOC content, dyes, fragrances, anti-redeposition agents, corrosion inhibitors, buffering agents, defoamers, antimicrobial agents, and preservatives. It is expected that certain of these components can be provided so that they participate in the hydration competition. That is, certain of these components can be considered either hydrated components or hydratable components depending upon whether they enter into the hydration competition and whether they surrender water of hydration or gain water of hydration. Of course, it is not necessary for any of the additional components to enter into the hydration competition. In addition, certain additional components which can be incorporated into the solid detergent composition can include heat sensitive materials. In general, a difficulty in introducing heat sensitive materials into solid detergent compositions that are formed by the application of heat to generate a composition having a relatively high temperature results in denaturing or deterioration of heat sensitive materials. In general, certain fragrances are considered to be fairly fragile and can be damaged by heat, and can volatilize. Certain preservatives are considered to be heat sensitive and decompose upon application of heat. In addition, certain solvents may devolatilize and certain enzymes may denature when exposed to elevated temperatures. In general, it can be advantageous to maintain the temperature of the composition during the formation of the molded detergent composition according to the invention at a temperature below about 50° C. or below about 40° C. or below about 30° C. depending on the materials in the composition. The temperature of the composition during mixing and molding can be provided below 25° C., and can be provided in a range of between about 20° C. and about 25° C.

The molded detergent composition according to the invention can include enzymes. In general, prior art molded detergent compositions that rely upon heat as a step in the solidification process do not include enzymes because enzymes tend to become denatured by the application of heat. According to the invention, enzymes can be incorporated into the molded detergent composition because the molded detergent composition can be prepared without the addition of heat. Exemplary types of enzymes which can be incorporated into the molded detergent composition include protease, lipase, amylase, cellulase, and mixtures thereof. In particular, it is an advantage of the invention that the molded detergent composition can include a mixture of protease with at least one of lipase, amylase, and cellulase. Because the molded detergent composition is provided in a solid form, the protease will be precluded from attacking other enzymes until the detergent composition is liquefied. An exemplary protease which can be included in the molded detergent composition according to the invention is available under the name Purafect 4000L from Genecor. An exemplary lipase which can be incorporated into the molded detergent composition of the invention is available under the name Lipolase 100T from Novo Nordisk. An exemplary amylase which can be incorporated into the molded detergent composition of the invention is available under the name Maxamyl WL15,000 from Gist-Brocades. An exemplary cellulase which can be incorporated into the molded detergent composition of the invention is available under the name Celluzyme 0.7T from Novo Nordisk.

The enzymes can be incorporated into the molded detergent composition in an amount which is useful for cleaning applications. In general, the amount of enzyme incorporated is controlled by the cost of the enzyme. The molded detergent composition can include a total enzyme content of between about 0.01 wt. % and about 10 wt. % based upon the weight of the molded detergent composition, and can include between about 0.1 wt. % and about 5 wt. %, and between about 0.5 wt. % and about 2 wt. %.

Additional components which can be incorporated into the molded detergent composition and which are sensitive to heat include fragrances, dyes, preservatives, and anti-microbial agents. It is an advantage of the invention that temperature sensitive materials can be incorporated into the molded composition. A preferred anti-microbial agent which can be incorporated into the molded detergent composition includes paraben materials such as propyl paraben. In general, paraben materials tend to decompose at elevated temperatures.

Exemplary anti-redeposition agents which can be incorporated into the molded composition include sodium carboxy methylcellulose, sodium polyacrylate, and hydroxypropyl cellulose. Exemplary corrosion inhibitors which can be incorporated into the molded composition include triethanolamine, and doderylamine. Exemplary buffering agents which can be incorporated into the molded composition include sodium acetate, potassium dihydrogen phosphate, and sodium borate. Exemplary defoamers which can be incorporated into the molded composition include polymeric silicone derivatives, and alkynol derivatives. Exemplary antimicrobial agents which can be incorporated into the molded composition include tert-amylphenol, quaternary ammonium compounds, and active halogen containing compounds. Exemplary aesthetic additives which can be used include dyes and fragrances. A preferred dye includes dye #2, and a preferred fragrance includes lemon fragrance.

The invention can be used to contain solvent materials commonly used in the cleaning industry in a solid form. Many of the solvents are considered high VOC solvents. By high VOC, it is meant that the solvent contributes to air pollution by the Environmental Protection Agency's VOC regulated limits. According to the invention, these types of materials can be incorporated into the detergent composition and contained in such a way that the volatile organic compound level of the molded detergent composition is relatively low. A solvent which is commonly used in the cleaning industry and which is considered to be relatively high VOC is butoxy ethanol. Butoxy ethanol is commonly available under the name Butyl Cellusolve from Union Carbide. High VOC solvents that can be included in the detergent include those solvents having a VOC level similar or higher than butoxy ethanol.

The molded detergent composition according to the invention can be used for warewashing applications and laundry applications. The molded detergent composition can be used for laundry washing applications, window or glass cleaning applications carpet cleaning applications, and hard surface cleaning applications. It should be understood that hard surfaces refer to surfaces that are nonfibrous and that are considered to be relatively hard such as countertops, floors, ceramics, and glass. Machines useful for using the molded detergent composition according to the invention are commercially available. Dispensers can be provided for using the molded detergent composition for cleaning carpets and hard surfaces.

EXAMPLE 1

Twenty eight detergent compositions were prepared, and the melting point of each composition was measured. The starting material for each composition is reported in Table 1 and the amount of each component is expressed as a weight percent of starting material based upon the total weight of the composition. Each composition was prepared by prehydrating the inorganic material with the amount of water indicated. The compositions were mixed together and allowed to stand in a mold. The compositions were initially very soft (exhibiting a melting point near room temperature), but hardened over time. The initial compositions could be characterized as soft solids or pastes. The melting points reported in Table 1 were measured after the compositions were allowed to harden. The melting points were determined after the compositions were observed to have finished hardening.

TABLE 1

| Component | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| sodium tripolyphosphate[1] | 23.8 | 22.7 | 20.0 | 15.0 | 25.0 | 25.0 | 25.0 | 40.0 | 19.0 | 21.5 | 20.0 | 25.0 | 20.0 | 19.0 |
| sodium metasilicate[2] | 47.6 | 45.5 | 50.0 | 50.0 | 50.0 | 50.0 | 45.0 | 40.0 | 36.0 | 38.5 | 40.0 | 30.0 | 40.0 | 36.0 |
| sodium carbonate[3] | 0 | 0 | 0 | 0 | 0 | 0 | 0 | 0 | 0 | 0 | 0 | 0 | 0 | 0 |
| NPE-9.5[4] | 0 | 0 | 5.0 | 10.0 | 5.0 | 10.0 | 5.0 | 10.0 | 10.0 | 10.0 | 10.0 | 10.0 | 20.0 | 0 |
| NPE-4.5[5] | 0 | 0 | 0 | 0 | 0 | 0 | 0 | 0 | 0 | 0 | 0 | 0 | 0 | 10.0 |
| NPE-12[6] | 0 | 0 | 0 | 0 | 0 | 0 | 0 | 0 | 0 | 0 | 0 | 0 | 0 | 0 |
| laureth-myristeth-7 E0[7] | 4.8 | 9.1 | 0 | 0 | 0 | 0 | 0 | 0 | 0 | 0 | 0 | 0 | 0 | 0 |
| LF-40 (EO/PO)[8] | 0 | 0 | 0 | 0 | 0 | 0 | 0 | 0 | 0 | 0 | 0 | 0 | 0 | 0 |
| LF-62 (EO/PO)[9] | 0 | 0 | 0 | 0 | 0 | 0 | 0 | 0 | 0 | 0 | 0 | 0 | 0 | 0 |
| sodium dodecylvenzene sulfonate[10] | 0 | 0 | 0 | 0 | 0 | 0 | 0 | 0 | 0 | 0 | 0 | 0 | 0 | 0 |
| water | 23.8 | 22.7 | 25.0 | 22.7 | 20.0 | 15.0 | 25.0 | 25.0 | 35.0 | 30.0 | 30.0 | 35.0 | 20.0 | 35.0 |
| mp (C) | 50.0 | 50.0 | 70.0 | 30.0 | 70.0 | 90.0 | 70.0 | 50.0 | 45.0 | 60.0 | 70.0 | 70.0 | wet | 70.0 |

| Component | 15 | 16 | 17 | 18 | 19 | 20 | 21 | 22 | 23 | 24 | 25 | 26 | 27 | 28 |
|---|---|---|---|---|---|---|---|---|---|---|---|---|---|---|
| sodium tripolyphosphate | 19.0 | 19.0 | 19.0 | 19.0 | 19.0 | 21.5 | 16.5 | 21.5 | 21.5 | 21.5 | 16.5 | 22.0 | 15.0 | 27.7 |
| sodium metasilicate | 36.0 | 36.0 | 36.0 | 36.0 | 36.0 | 38.5 | 33.5 | 38.5 | 38.5 | 38.5 | 33.5 | 59.0 | 35.8 | 24.5 |
| sodium carbonate | 0 | 0 | 0 | 0 | 0 | 0 | 0 | 0 | 0 | 0 | 0 | 0 | 0 | 0 |
| NPE-9.5 | 0 | 0 | 0 | 0 | 0 | 0 | 0 | 0 | 0 | 0 | 0 | 11.0 | 11.6 | 11.6 |
| NPE-4.5 | 0 | 0 | 0 | 0 | 0 | 10.0 | 0 | 0 | 0 | 0 | 0 | 0 | | |
| NPE-12 | 10.0 | 0 | 0 | 0 | 0 | 0 | 10.0 | 0 | 0 | 0 | 0 | 0 | 0 | 0 |
| laureth-myristeth-7 EO | 0 | 10.0 | 0 | 0 | 0 | 0 | 0 | 20.0 | 0 | 0 | 0 | 0 | 0 | 0 |
| LF-40 (EO/PO) | 0 | 0 | 10.0 | | 0 | 0 | 0 | 0 | 20.0 | 0 | 0 | 0 | 0 | 0 |
| LF-62 (EO/PO) | 0 | 0 | 0 | 10.0 | 0 | 0 | 0 | 0 | 0 | 10.0 | 10.0 | 0 | 0 | 0 |
| sodium dodecylvenzene sulfonate | 0 | 0 | 0 | 0 | 10.0 | 0 | 0 | 0 | 0 | 0 | 0 | 3.0 | 3.2 | 3.2 |
| water | 35.0 | 35.0 | 35.0 | 35.0 | 35.0 | 30.0 | 40.0 | 20.0 | 20.0 | 30.0 | 40.0 | 5.0 | 34.4 | 33.0 |
| mp (C) | 70.0 | 65.0 | 65.0 | 65.0 | soft | 50.0 | wet | wet | wet | 70.0 | soft | 60.0 | 70.0 | 75.0 |

[1]Sodium tripolyphosphate has a melting point greater than 500° C.
[2]Sodium metasilicate has a melting point greater than 500° C.
[3]Sodium carbonate has a melting point greater than 500° C.
[4]NPE-9.5 is nonylphenol ethoxylate having an average of nine ethylene oxide units, and is provided as a liquid at room temperature, and is available from Huntsman Chemical.
[5]NPE-4.5 is nonylphenol ethoxylate having an average of 4.5 ethylene oxide units per molecule, and is a liquid at room temperature, and is available from Huntsman Chemical.
[6]NPE-12 is nonylphenol ethoxylate having an average of 12 ethylene oxide groups per molecule and is available as a liquid at room temperature, and is available from Huntsman Chemical.
[7]Laureth-myristeth-7 EO is an aliphatic ethoxylate available under the name Surfonic L24-7 from Huntsman Chemical.
[8]LF-40 (EO/PO) is an ethylene oxide/propylene oxide copolymer, and is available as a liquid at room temperature.
[9]LF-62 (EO/PO) is an ethylene oxide/propylene oxide copolymer, and is available as a liquid at room temperature.
[10]Sodium dodecylbenzene sulfonate is available as a liquid at room temperature.

It is believed that sample composition numbers 13, 19, 21–23, and 25 include too much water for the surfactant to handle to allow for solidification.

The above discussion, examples and data provide a basis for understanding the disclosure. However, the invention can embody a variety of compositions and methods. The invention accordingly is found in the claims hereinafter appended.

We claim:

1. A method for manufacturing a molded detergent composition, the method comprising steps of:

(a) mixing a hydrated component and a hydratable component at a weight ratio of the hydrated component to the hydratable component of about 5:1 to about 20:1 based on the anhydrous weight of each component to provide a mixture:

(i) the hydrated component comprising a hydrated salt having a melting point below about 100° C. and comprising a transhydration product of an anhydrous salt and water of hydration, the anhydrous salt having a melting point greater than about 300° C.;

(ii) the hydratable component comprising water, if present at all, at a level of less an about 2 wt. % based on the weight of the hydratable component;

(iii) the hydratable component comprising a polar organic component which successfully competes with the hydrated component for at least a portion of the water of hydration; and (iv) the hydrated component being provided in a solid state during the step of mixing and in an amount of at least about 40 wt. % based on the weight of the anhydrous salt in the mixture; and (b) molding the mixture by extrusion to provide a molded detergent composition having a melting point greater than about 30° C., wherein the composition solidifies in an amount of time sufficient to provide the composition in a desired molded shape to about 15 minutes.

2. A method according to claim 1, wherein the hydrated salt comprises a hydrate of at least one of sodium silicate, lithium silicate, potassium silicate, sodium metasilicate, sodium phosphate, calcium phosphate, magnesium phosphate, sodium pyrophosphate, sodium tripolyphosphate, sodium sulfate, sodium carbonate, sodium bicarbonate, sodium sesquicarbonate, sodium bisulfate, sodium thiosulfate, sodium percarbonate, or mixtures thereof.

3. A method according to claim 1, wherein the hydratable component comprises at least one of nonionic surfactant, anionic surfactant, or mixture thereof.

4. A method according to claim 1, wherein the step of mixing further comprises mixing butoxy ethanol with the hydrated component and the hydratable component.

5. A method according to claim 1, wherein the weight ratio of the hydrated component to the hydratable component is between about 8:1 and about 15:1 based on an anhydrous weight of each component.

6. A method according to claim 1, wherein the step of mixing comprises mixing an effective cleaning amount of an enzyme in the mixture.

7. A method according to claim 6, wherein the enzyme is present in an amount of about 0.01 wt. % to about 10 wt. % based on the weight of the mixture.

8. A method according to claim 6, wherein the enzyme comprises at least one of protease, lipase, amylase, cellulase, or mixtures thereof.

9. A method according to claim 6, wherein the enzyme comprises a mixture of protease and cellulase.

10. A method according to claim 1, wherein the mixture comprises at least one of a material sensitive to heat.

11. A method according to claim 10, wherein the material sensitive to heat comprises at least one of fragrances, dyes, preservatives, or enzymes.

12. A method according to claim 1, wherein the mixture provided during the step of mixing is provided at a temperature of less than about 50° C.

13. A method according to claim 1, wherein the mixture provided during the step of mixing is provided at a temperature of less than about 40° C.

14. A method according to claim 1, wherein the hydrated component is provided in an amount of about 40 wt. % to less than about 90 wt. % based on the weight of the anhydrous salt in the mixture.

15. A method according to claim 1, wherein the hydrated component is provided in an amount of about 50 wt. % to about 80 wt. % based on the weight of the anhydrous salt in the mixture.

* * * * *